US005819445A

United States Patent [19]

LaBelle et al.

[11] Patent Number: 5,819,445

[45] Date of Patent: Oct. 13, 1998

[54] FRONT-END LOADER ACCESSORY ATTACHMENT WITH HYDRAULICALLY ACTUATED PIVOTAL DRUM ASSEMBLY

[75] Inventors: Hector LaBelle; Daniel LaBelle, both of c/o Hector Labelle Equipment enr. 827, Route 148, Thurso, Quebec, Canada, J0X 3B0

[73] Assignees: Hector LaBelle; Daniel LaBelle, both of Quebec, Canada

[21] Appl. No.: 760,587

[22] Filed: Dec. 4, 1996

[30] Foreign Application Priority Data

Jan. 23, 1996 [CA] Canada ..... 2,167,879

[51] Int. Cl.[6] ..... E02F 3/96

[52] U.S. Cl. ..... 37/404; 37/443; 414/912; 74/108; 172/817

[58] Field of Search ..... 74/99 R, 107, 74/108; 37/404, 403, 406, 407, 468; 172/245–254, 810, 811, 817, 272; 414/912, 723; 280/163

[56] References Cited

U.S. PATENT DOCUMENTS

| | | | |
|---|---|---|---|
| 1,006,576 | 10/1911 | Mattson . | |
| 1,429,768 | 9/1922 | Reardon . | |
| 1,460,930 | 7/1923 | Walters . | |
| 2,258,890 | 10/1941 | Gustafson | 37/156 |
| 2,404,639 | 7/1946 | Lane | 74/108 |
| 2,559,733 | 7/1951 | Pitman et al. | 74/108 X |
| 2,637,123 | 5/1953 | Miller | 37/9 |
| 3,033,380 | 5/1962 | Dorkins | 74/108 X |
| 3,059,487 | 10/1962 | Anderson | 74/108 |
| 3,202,000 | 8/1965 | Fischer | 74/108 |
| 3,524,269 | 8/1970 | Jackoboice | 37/42 |
| 4,117,944 | 10/1978 | Beckstrom et al. | 172/272 X |
| 4,865,516 | 9/1989 | Focke et al. | 74/108 X |
| 4,924,610 | 5/1990 | Sodemann | 37/231 |
| 5,004,398 | 4/1991 | Wagner et al. | 172/273 X |
| 5,098,252 | 3/1992 | Sheesley et al. | 172/273 X |
| 5,176,485 | 1/1993 | Ruder et al. | 414/392 |

FOREIGN PATENT DOCUMENTS

| | | |
|---|---|---|
| 302572 | 7/1930 | Canada . |
| 710518 | 6/1965 | Canada . |
| 732265 | 4/1966 | Canada . |
| 992495 | 7/1976 | Canada . |

OTHER PUBLICATIONS

Kasco Skid Steer Blades brochure, Skid Steer mounted blade shown with optional bracker for Gehl Jun. 1996.

Kasco Hitching systems web site Jul. 1996.

*Primary Examiner*—Terry Lee Melius
*Assistant Examiner*—Victor Batson
*Attorney, Agent, or Firm*—Rhodes Coats & Bennett, L.L.P.

[57] ABSTRACT

An accessory attachment/conversion assembly is disclosed for use on a small front-end loader type of construction implement. One form of accessory would be a backhoe bucket. The attachment assembly includes a frame for detachable mounting to the implement and includes a rotatable drum pivotally secured to the frame and rotatable in its mounting by means of chains, or other suitable forms of transmission means, which are secured at one of their ends to the drum and at their other ends to a hydraulic cylinder mounted on the frame. An elongated arm or boom is secured at one end to the drum and extends outwardly thereof. The outer terminal end of the boom can carry a bucket or other suitable accessory. The arrangement being such that the boom and bucket can be swung approximately full left to full right, almost 180°.

5 Claims, 15 Drawing Sheets

FRONT-END LOADER ACCESSORY ATTACHMENT WITH HYDRAULICALLY ACTUATED PIVOTAL DRUM ASSEMBLY

FIELD OF THE INVENTION

The present invention relates to front-end loaders and in particular, but not limited to, front-end loaders of the smaller, construction type and to an accessory attachment for such a vehicle.

BACKGROUND OF THE INVENTION

Small implement vehicles for use on construction sites, around farms and the like are normally rather limited in their functions. One example is the four wheel drive and two wheel drive rubber tire vehicles that have front-end loader mechanisms attached thereto. These mechanisms normally comprise a pair of side-by-side actuating arm units which, together, carry a wide bucket or shovel and the arms operate the bucket or shovel through a vertical plane and are able to rotate the bucket about a horizontal axis so as to fill it and subsequently dump it.

Vehicles of this nature are, as mentioned above, sometimes limited in their functions and if for example an operator wishes to have some means for digging trenches or the like then it is necessary for him to obtain another vehicle in the form of a backhoe. This is both time consuming, inefficient and very expensive to a small operator or construction businessman.

The present invention is directed to expanding the functions of vehicles of the above described type by providing an accessory attachment to convert the front-end loader mechanism to means for effecting other functions such as a backhoe arrangement. The conventional, wide bucket is removed from the front-end loader actuating arms and is replaced by a frame member supporting an elongated boom or arm having an implement such as a backhoe bucket at its outer terminal end. Means are provided for swinging the arm from left to right and the front-end loader actuating arms are utilized to move the arm and the bucket through a vertical plane.

PRIOR ART

There are some early examples of implements having means for moving a tool or piece of functional equipment in a horizontal plane with respect to the vehicle to which it is attached.

U.S. Pat. No. 3,524,269 of Aug. 18, 1970 shows a device for raising and lowering a plough blade on the front of the vehicle. A semi-circular drum is connected to a hydraulic ram by means of a pivot and a drum is also connected by way of a chain to a bumper of the vehicle. When an associated hydraulic ram is actuated, the drum is rotated to raise and lower the blade.

U.S. Pat. No. 2,637,123 of May 5th, 1953 discloses a blade on an earth scraper and which is raised or lowered by means of rotation of a sprocket that is secured to the blade and a chain trained around the sprocket and actuated by a hydraulic ram.

U.S. Pat. No. 4,924,610 of May 15th, 1990 discloses an apparatus for a snowplough attachment where the upper ends of a snowplough blade are suspended from a pulley for the purpose of levelling or tilting the blade relative to the surface scraped or ploughed.

Other U.S. Pat. Nos. such as 1,429,768 of Sep. 19th, 1922; 1,006,576 of Oct. 24, 1911; 1,460,930 of Jul. 3, 1923; and 2,258,890 of Oct. 14, 1941 disclose various forms of vehicles, usually scrapers, that use chains to rotate or position a tool such as a blade relative to the longitudinal axis of the vehicle to which it is attached.

U.S. Pat. No. 5,176,485 shows an arrangement whereby the end structure of a forklift apparatus can be moved left or right by means of a pair of cylinders, a connecting chain and a sprocket.

Canadian Patent 710,518 shows a device for shifting the axis of a boom on an implement such as a backhoe and in which a pair of cylinders are used to pull left or right on a chain wrapped around a drum at one end of the boom. The boom can be moved left or right relative to the implement but does not change the direction of its longitudinal axis relative to that of the vehicle.

The present invention meets the requirements for a more versatile vehicle for the small operator in providing an attachment assembly that can be detachably mounted to the implement so that a common vehicle can be used for several functions through an accessory attachment/conversion assembly of the type exemplified in the invention.

SUMMARY OF THE INVENTION

According to a broad aspect, the invention relates to an accessory attachment assembly for use on a front-end loader vehicle of the type that includes a pair of spaced actuating arm units for carrying a wide bucket for elevation through a vertical plane and for rotating said wide bucket about a horizontal axis. The attachment assembly comprises a frame for detachable mounting to the vehicle arm units in place of the wide bucket thereon, a drum pivotally secured to the frame about a vertical axis and a hydraulic actuator mounted in the frame for reciprocal movement between the ends thereof. Transmission means interconnect the drum with the actuator whereby movement of the actuator in the frame effects rotary movement of the drum about its axis of rotation. An arm secured at its inner end to the drum is adapted to carry a ground engaging tool, such as a backhoe bucket, on its outer, terminal end.

The drum may comprise a semicircular cylinder and the flexible transmission members may comprise either chains, cables or toothed belts and where the transmission members are mounted one above the other on opposite side walls of the drum. The other, free ends of the transmission members are connected to opposite ends of the hydraulic actuator.

In a preferred embodiment the hydraulic actuator comprises a cylinder with a coaxial piston shaft therein, the shaft extending outwardly of both ends of the cylinder and each end of the shaft is secured in opposite end members of the frame. A piston on the shaft is located centrally of the cylinder and a collar is mounted on each end of the cylinder. There are means on each collar for receiving the free ends of the transmission means that are secured in the drum.

BRIEF DESCRIPTION OF THE DRAWINGS

The invention is illustrated by way of example in the accompanying drawings in which.

DETAILED DESCRIPTION OF A PREFERRED EMBODIMENT

Figure 1:
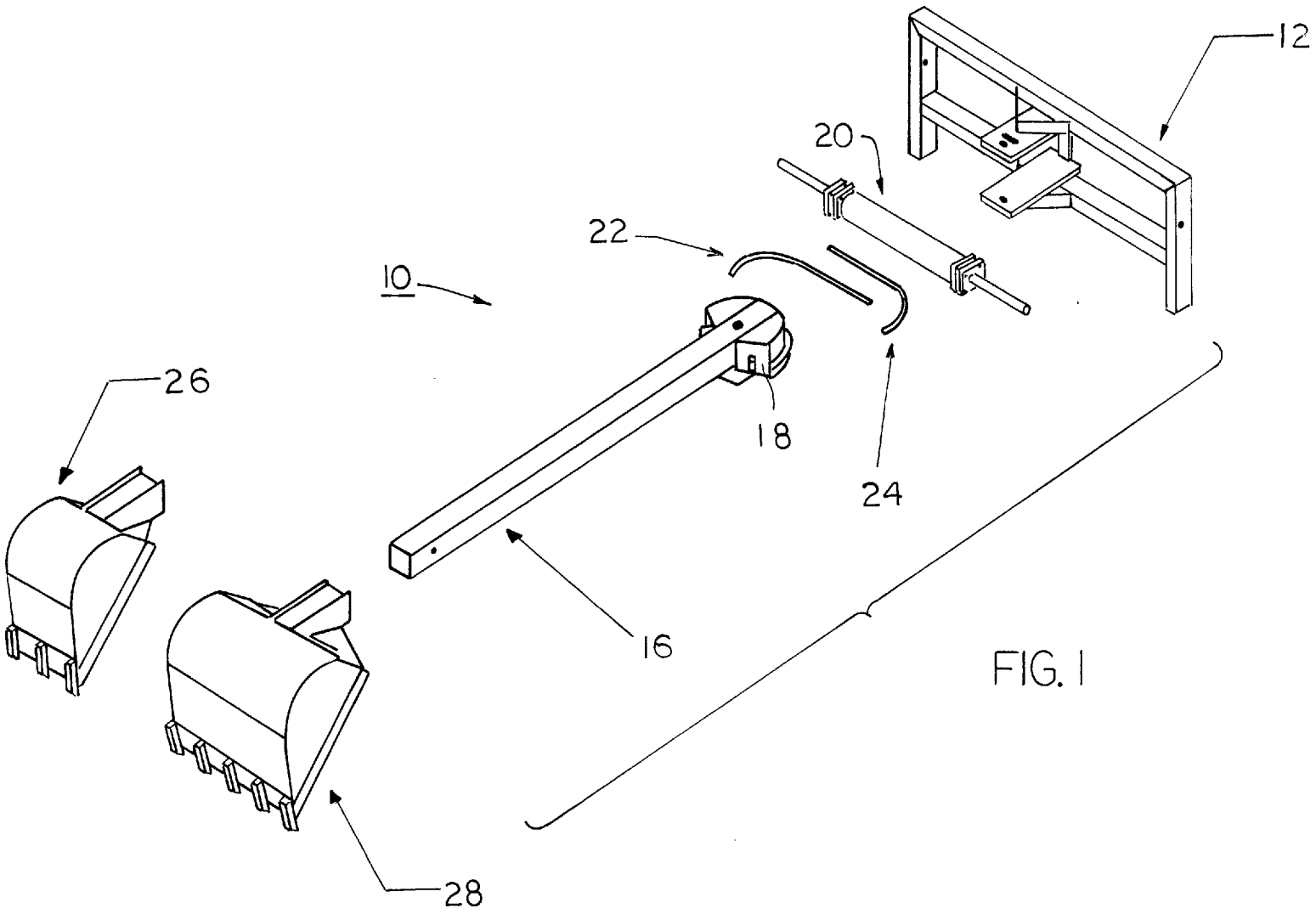
FIG. 1 is an exploded perspective view of the apparatus according to the invention.
Figure 6:
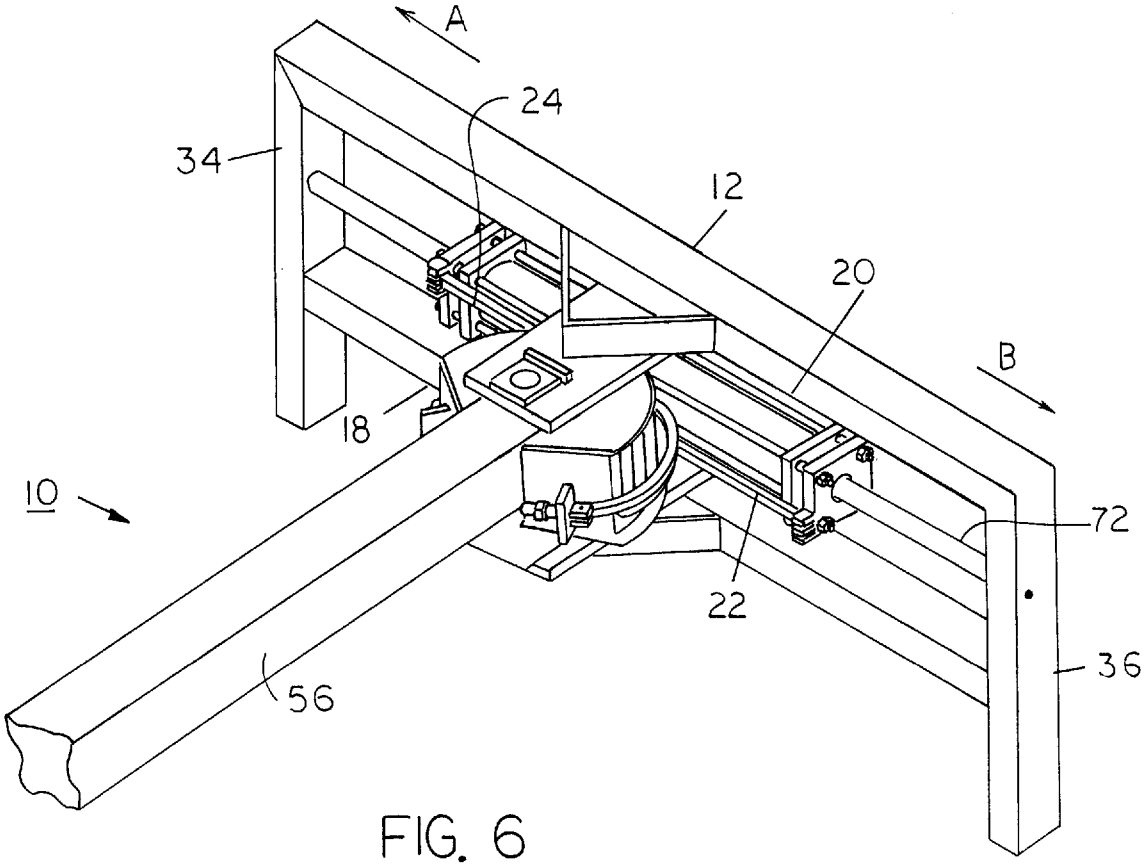
FIG. 6 is an isometric view of the accessory attachment fully assembled.
Figure 7:
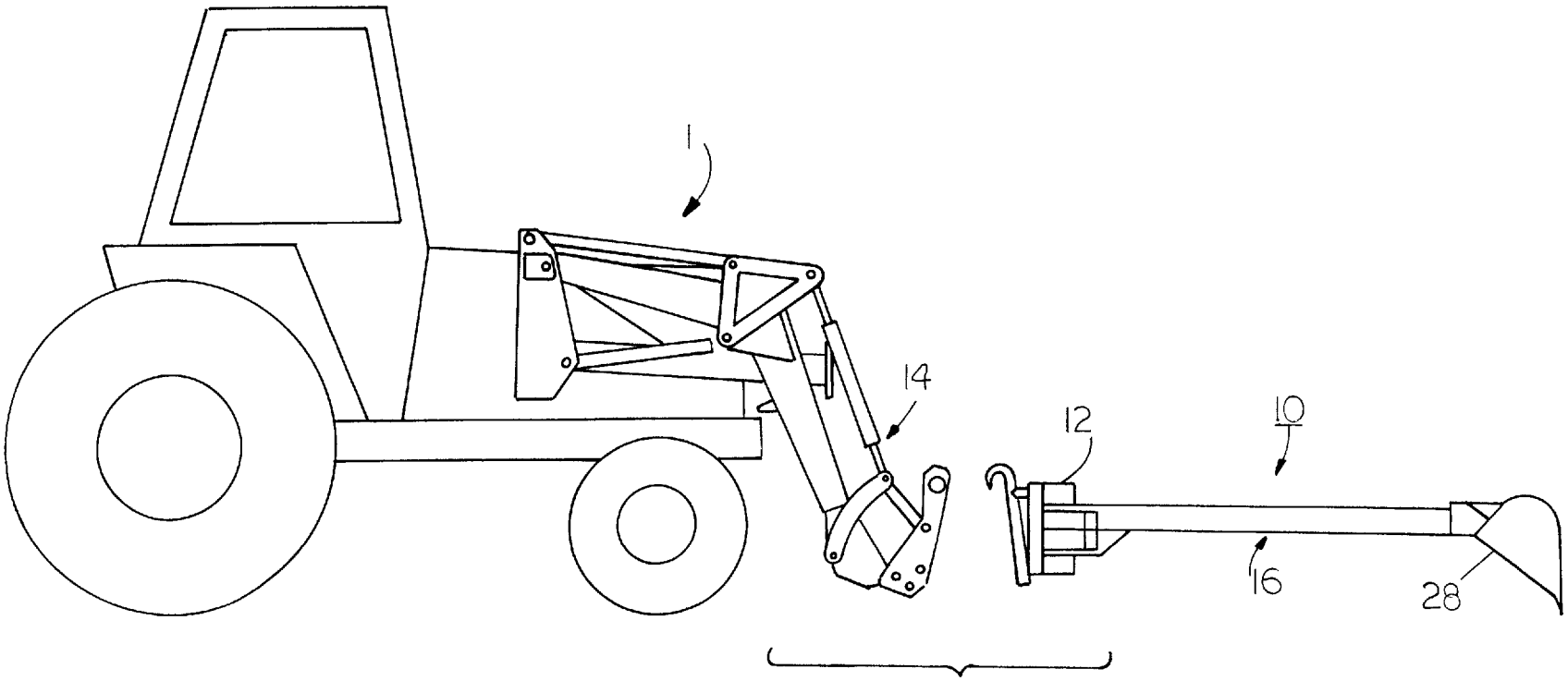
FIG. 7 is a side view illustrating the connection between the frame of the invention and the arms of a front-end loader.
Figure 8:
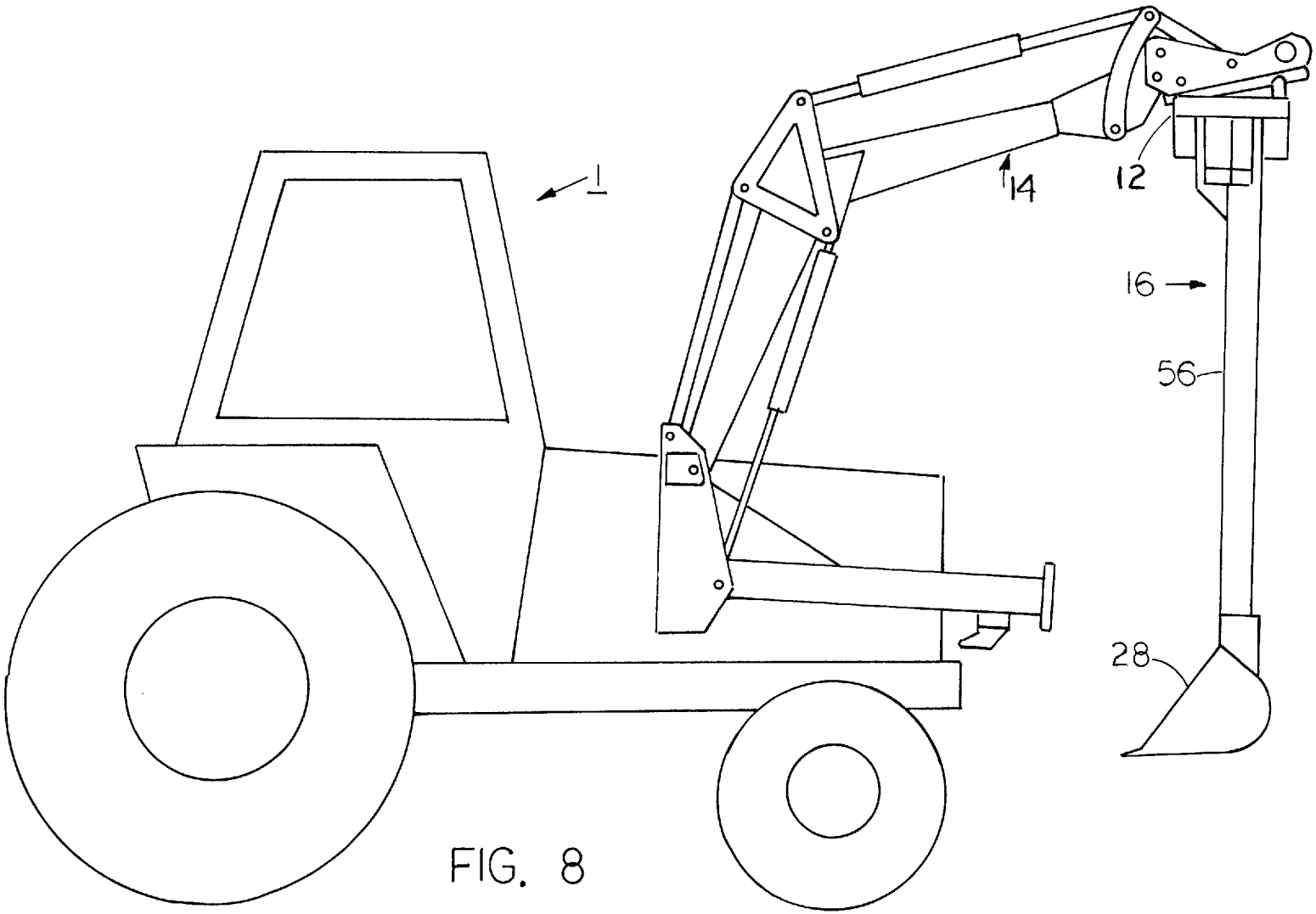
FIG. 8 is a side view of the apparatus in one operative position.
Figure 9:
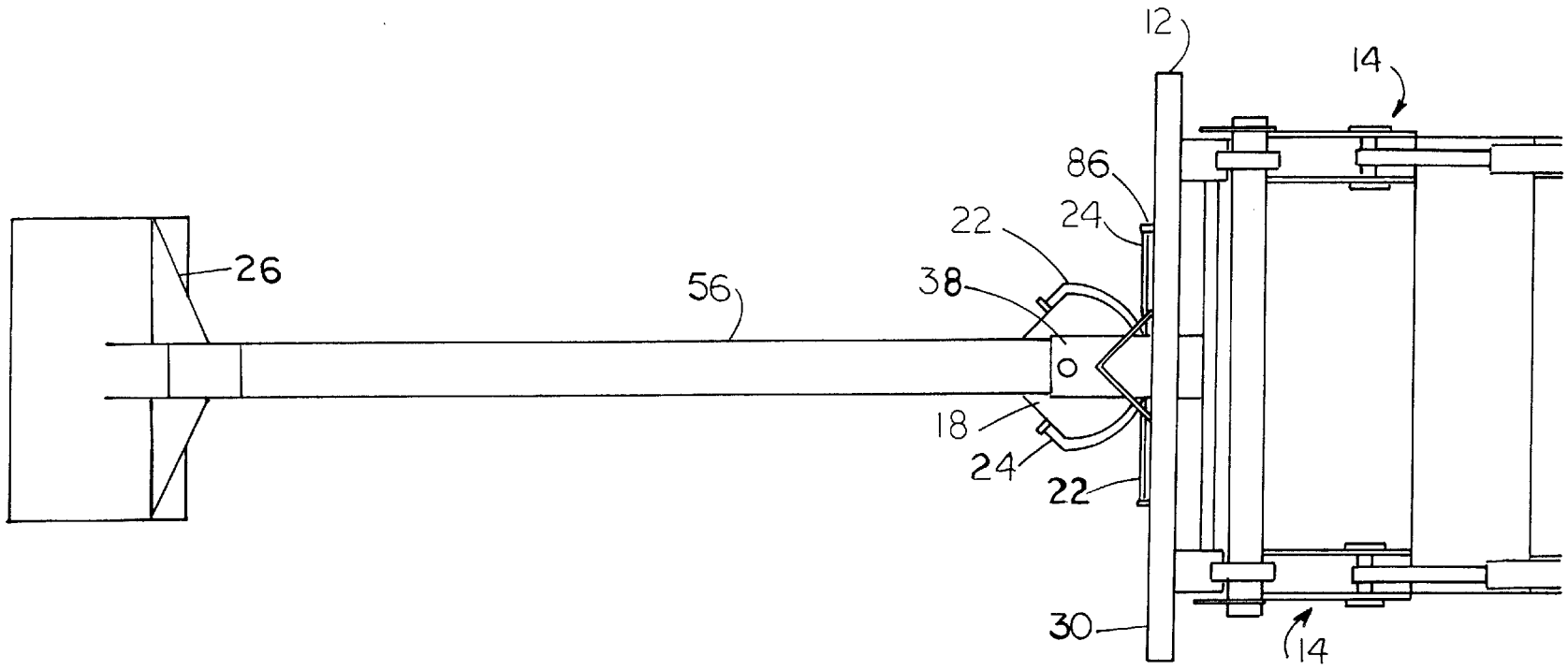
FIGS. 9, 10 and 11 are plan views of the apparatus in other operative positions.

Referring initially to FIGS. 1, 6 and 7 the accessory attachment assembly is indicated generally at 10 and is shown in the exploded view of FIG. 1 and in a fully assembled view in FIG. 6. As described, the assembly 10 is for use on a front-end loader vehicle 1 of the type that includes a pair of actuating arm units 14 for carrying a wide bucket and for elevating such a bucket through a vertical plane and for rotating the wide bucket about a horizontal axis. The bucket is removed from the actuating arms 14 and the accessory attachment assembly 10 is detachably secured to those arms, specifically by means of the frame 12 of the assembly as seen in FIGS. 7, 8 and 9.

The attachment 10 comprises a frame 12 for detachable mounting to the vehicle arm units 14, displacing the conventional wide bucket or shovel carried by those arms. A drum/boom arm subassembly 16 incorporates a drum 18 at its inner end and which is pivotally secured to the frame 12 about a vertical axis and for operation through a horizontal plane. Such action is provided by a hydraulic actuator 20 which is mounted in the frame for reciprocal movement between the ends thereof, the movement of the actuator 20 being transmitted to the drum/boom assembly through suitable transmission means such as a pair of chains 22, 24. The boom arm 16 is adapted to receive accessory tools such as a small bucket 26 or a larger backhoe bucket 28, on its outer end.

Figure 2:
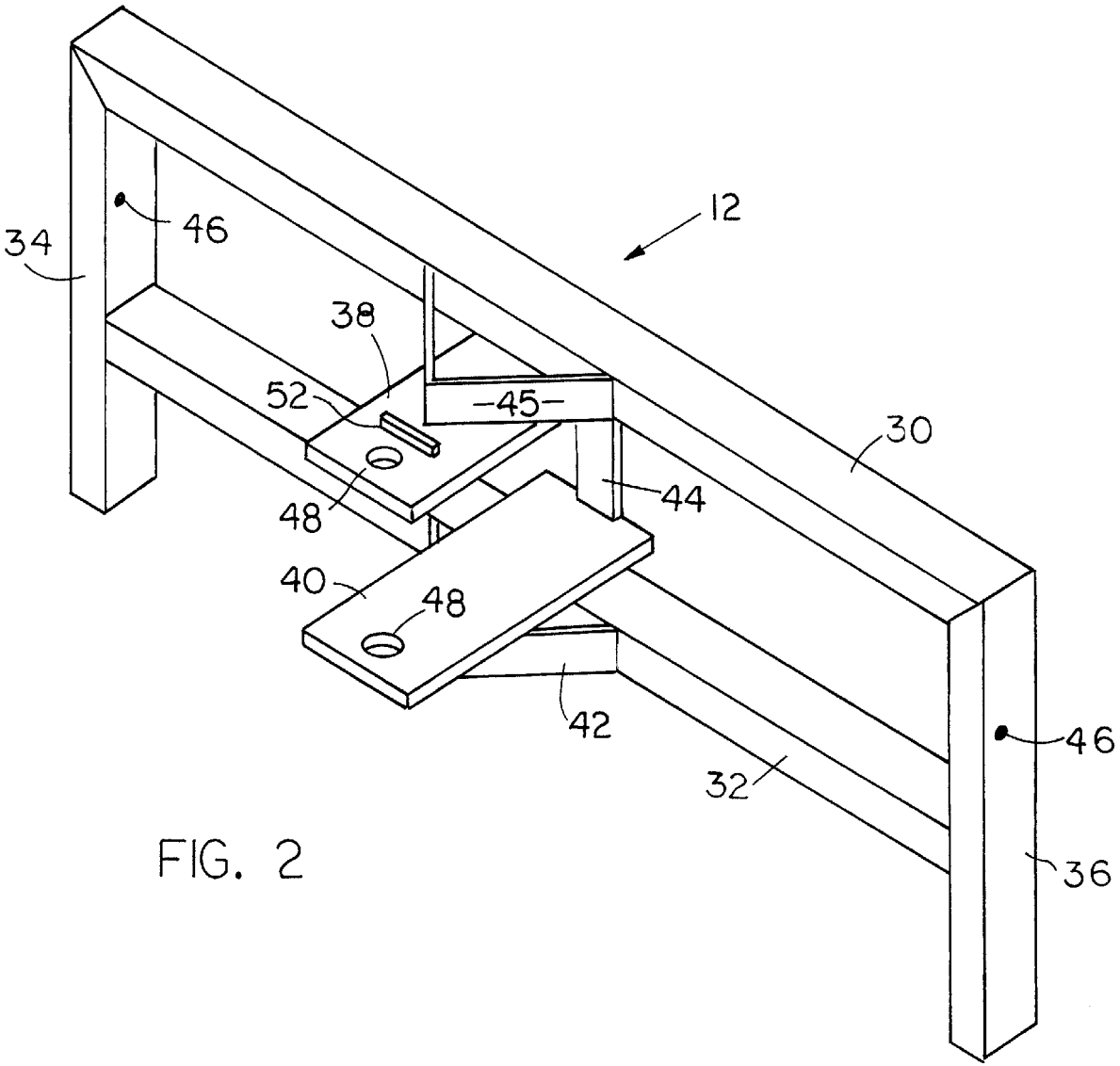
FIG. 2 is an isometric view of the frame of the apparatus according to the invention.

As shown in FIG. 2, frame 12 is of generally rectangular configuration having spaced, parallel upper and lower beams 30 and 32 respectively interconnected with end members 34 and 36. A pair of drum support plates 38 and 40 are secured to and extend outwardly from the upper and lower beams 30 and 32 respectively. These support plates are suitably reinforced by truss members 42 and a vertical member 44.

The end members 34, 36 of the frame are suitably drilled at 46 to receive the ends of the piston shaft of the hydraulic actuator as will be subsequently described.

Plates 38 and 40 are align drilled at 48 for the reception of a pivot pin 50 (FIG. 3) which locates the drum 18 on the support plates 38 and 40. A bar 52 on the upper drum support plate 38 interacts with a rectangular head 54 on the pivot pin 50 to prevent its rotation in the plates 38 and 40.

Figure 3:
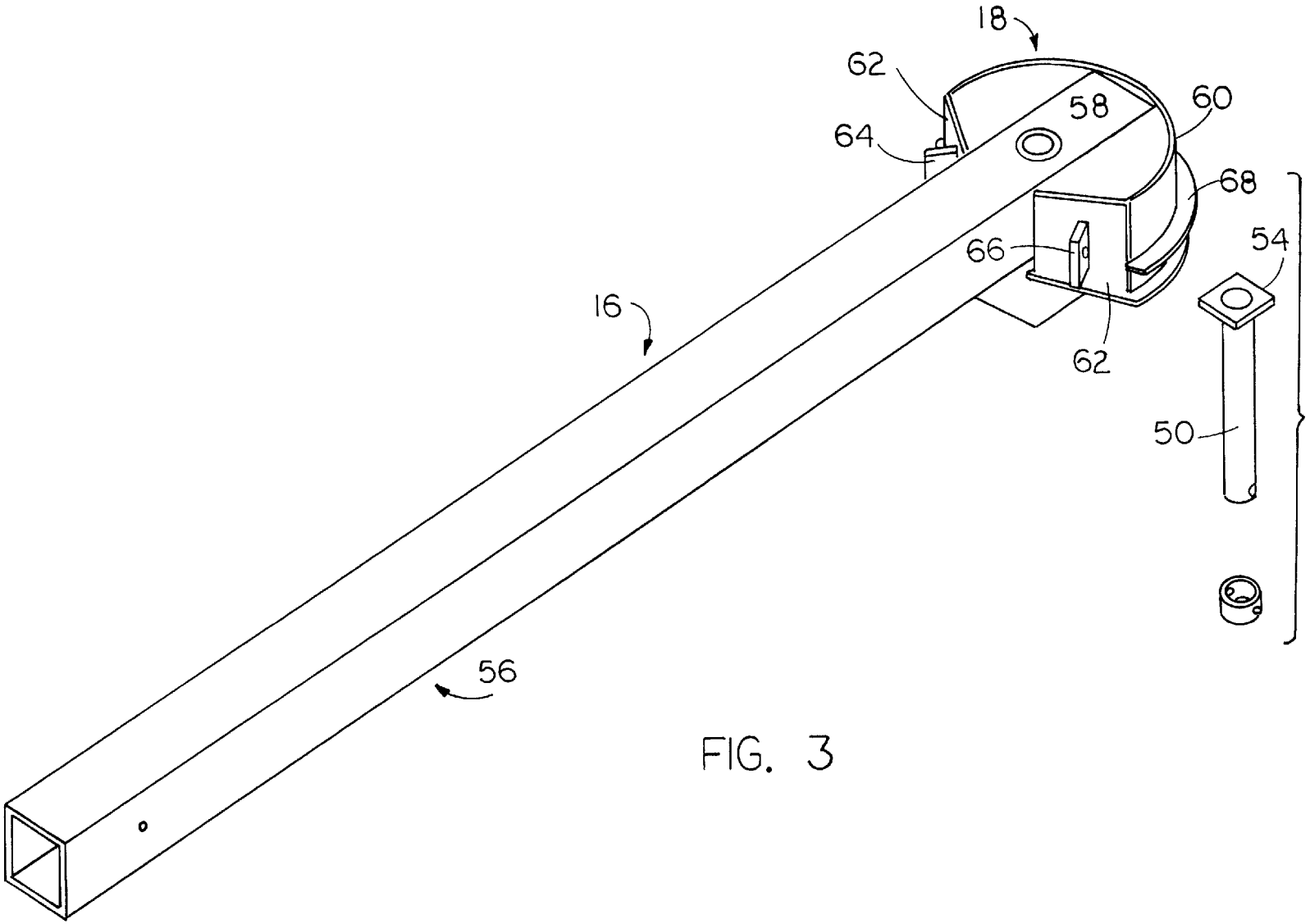
FIG. 3 is an isometric view of the boom arm of the apparatus according to the invention.

As shown in FIG. 3, the boom assembly 16 includes the boom arm 56 which can be of any suitable cross-sectional configuration, the illustrated example being of rectangular tubular construction. The inner end of the arm 56 is secured, for example, by welding to the drum 18 and the inner end of the arm is align bored at 58 to receive the pivot pin 50 when the drum is located between the drum support plates 38 and 40 illustrated in FIG. 2.

The drum 18 comprises a semicircular cylindrical wall 60 having a pair of rectangular plates 62 tapered outwardly from the terminal ends of the side wall 60 to the side surfaces of the arm 56 and being secured thereto. Plates 62 include anchors 64, 66 for securing the ends of the two transmission chains 22, 24 illustrated in FIGS. 1 and 6. Peripheral guide plate 68 secured to the side wall of the drum serves to separate the two transmission chains 22 and 24.

Figure 4:
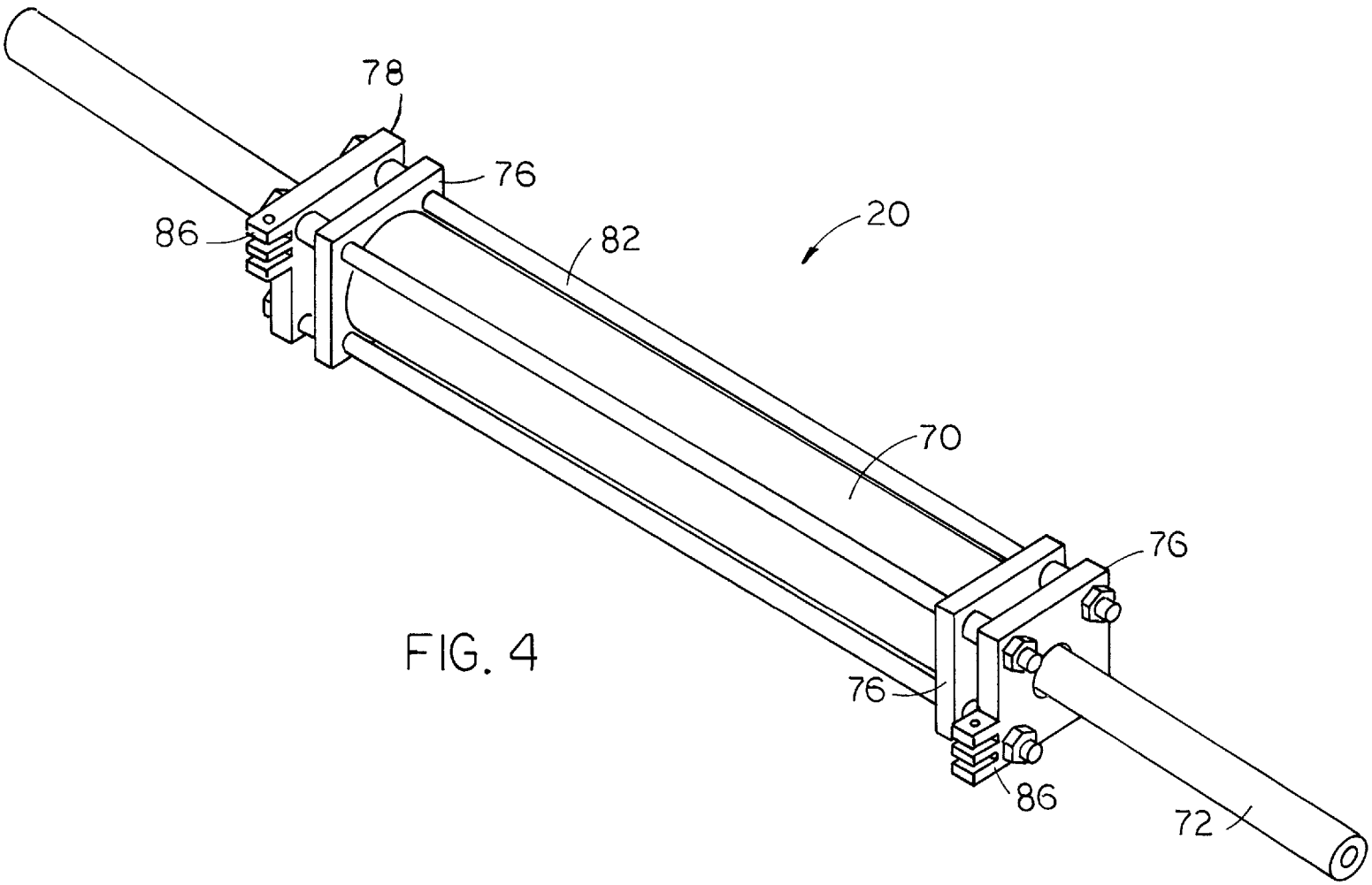
FIG. 4 is an isometric view of the hydraulic actuator according to the invention.
Figure 5:
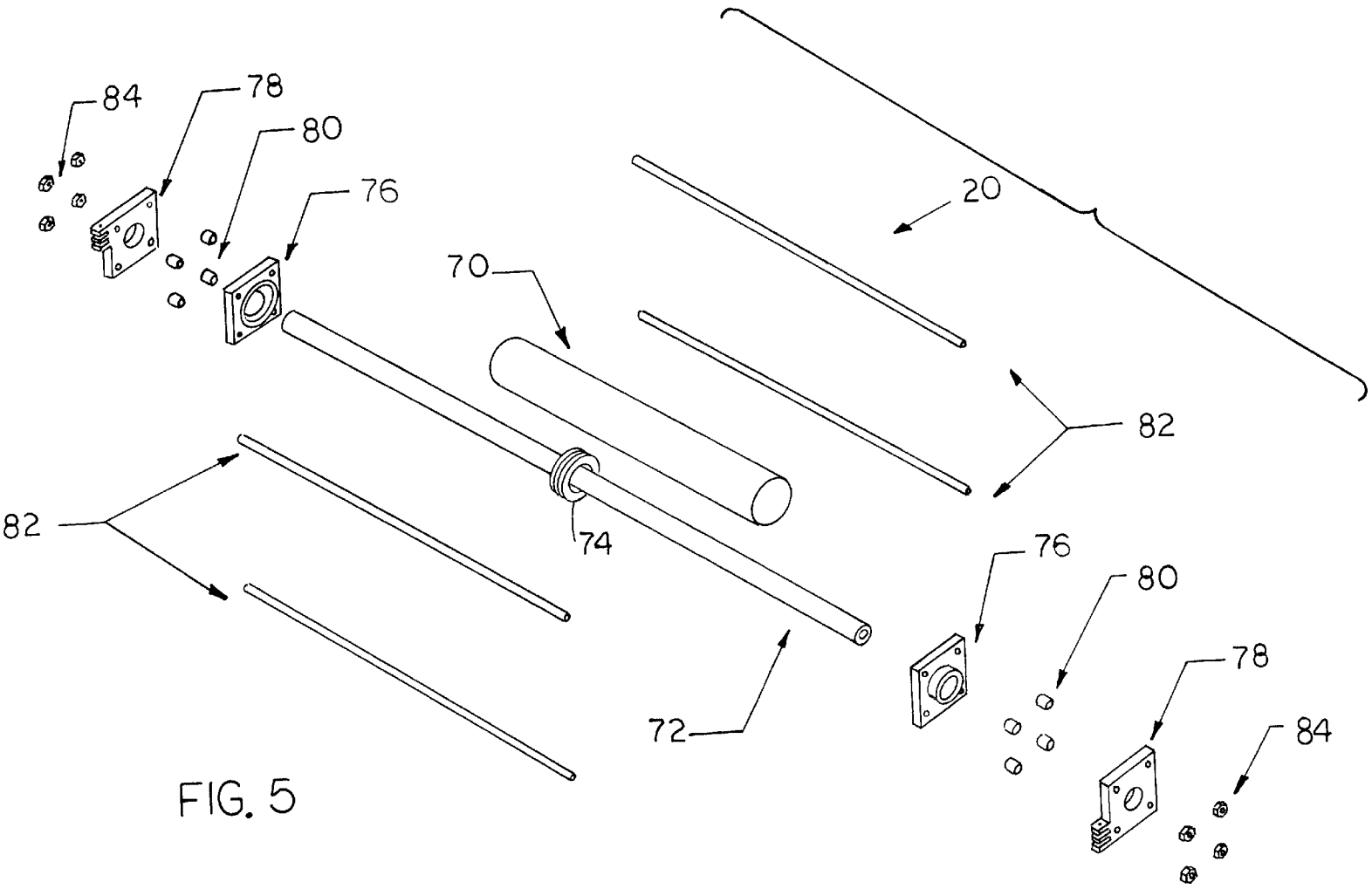
FIG. 5 is an exploded view of the cylinder assembly.

Turning now to FIGS. 4 and 5, the hydraulic actuator 20, shown in exploded view in FIG. 5, comprises a cylinder 70 having a piston shaft 72 and piston 74 located therein, the length of the piston shaft 72 substantially exceeding the length of the cylinder 70. The cylinder includes head plates 76 enclosing the ends of the cylinder, each end also including a transmission connector plate 78 located outwardly of the head plate 76 by means of spacers 80. The assembly is secured together by means of two pairs of elongated tie bolts 82 and suitable fasteners 84. As shown in FIG. 4, each of the transmission connector plates 78 includes lugs 86 for securing each end of the actuator 20 to the terminal ends of the transmission chains 22, 24. It will be appreciated from FIG. 1 and from FIG. 6 that one chain 22 is secured at one of its ends to the anchor plate 64 on the drum 18 and the other chain 24 is connected at its inner end to the anchor plate 66 on the drum as illustrated in FIG. 3. The other end of chain 22 would be connected to the anchor plate 86 on the right side of FIG. 4 whereas the transmission chain 24 would have its other end connected to the anchor plate 86 on the left hand side of the cylinder as shown in FIG. 4.

Referring now to FIG. 6, it will be seen that the outer terminal ends of the piston shaft 72 are secured in the apertures 46 in the frame ends 34 and 36. Due to the fact that the piston shaft is so secured, providing hydraulic pressure to either the left or right side of the piston 74 within the cylinder 70 causes the actuator 20 to move either to the left in the direction of arrow A, FIG. 6, or to the right in the frame in the direction of arrow B. It will be appreciated that, due to the connection of one end of each of the transmission chains 22, 24 to the connector plates 64 and 66 respectively and at their other ends to the connector plates 86 at the right and left ends respectively of the actuator 20, when the actuator moves to the left in the frame in the direction of arrow A, the drum 18 and the arm 56 will be pivoted to the right as seen in FIG. 11. When the cylinder moves in the direction of arrow B, the drum 18 and the arm are pivoted to the left, as shown in FIG. 10.

FIGS. 8 through 13 are views showing the operative movements of the boom arm assembly 16 under the guidance of the movement of the frame and the actuator.

FIG. 8 shows that by raising the frame 12 by the actuating arms 14 of the front-end loader 1, the arm 56 and bucket 28 can be raised upwardly and by pivoting the actuating arms 14 of the front-end loader, the frame 12 together with the assembly 16 and bucket 28 are moved downwardly through a vertical plane so that the bucket can engage the ground.

Figure 10:
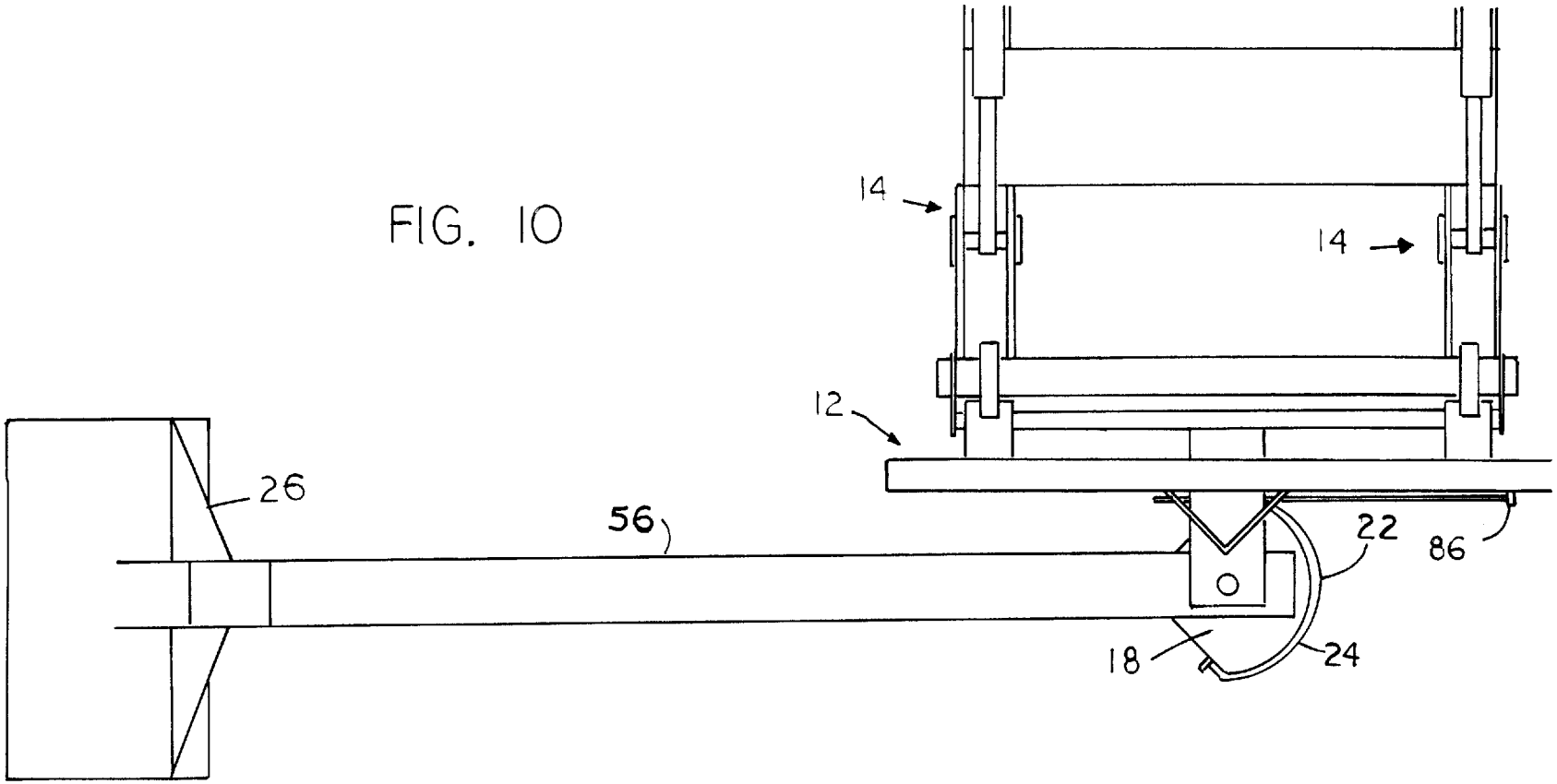
Figure 11:
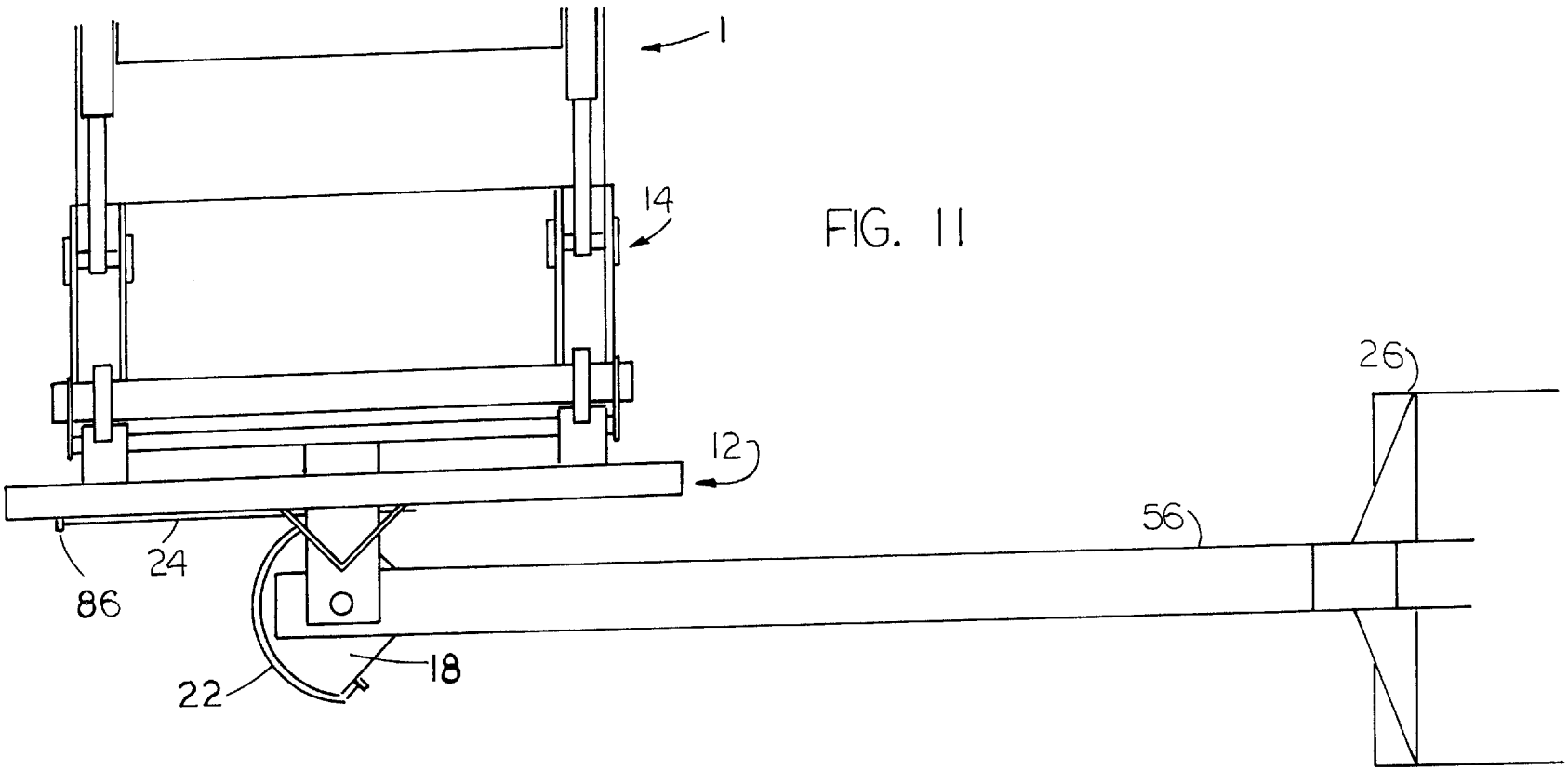
Figure 12:
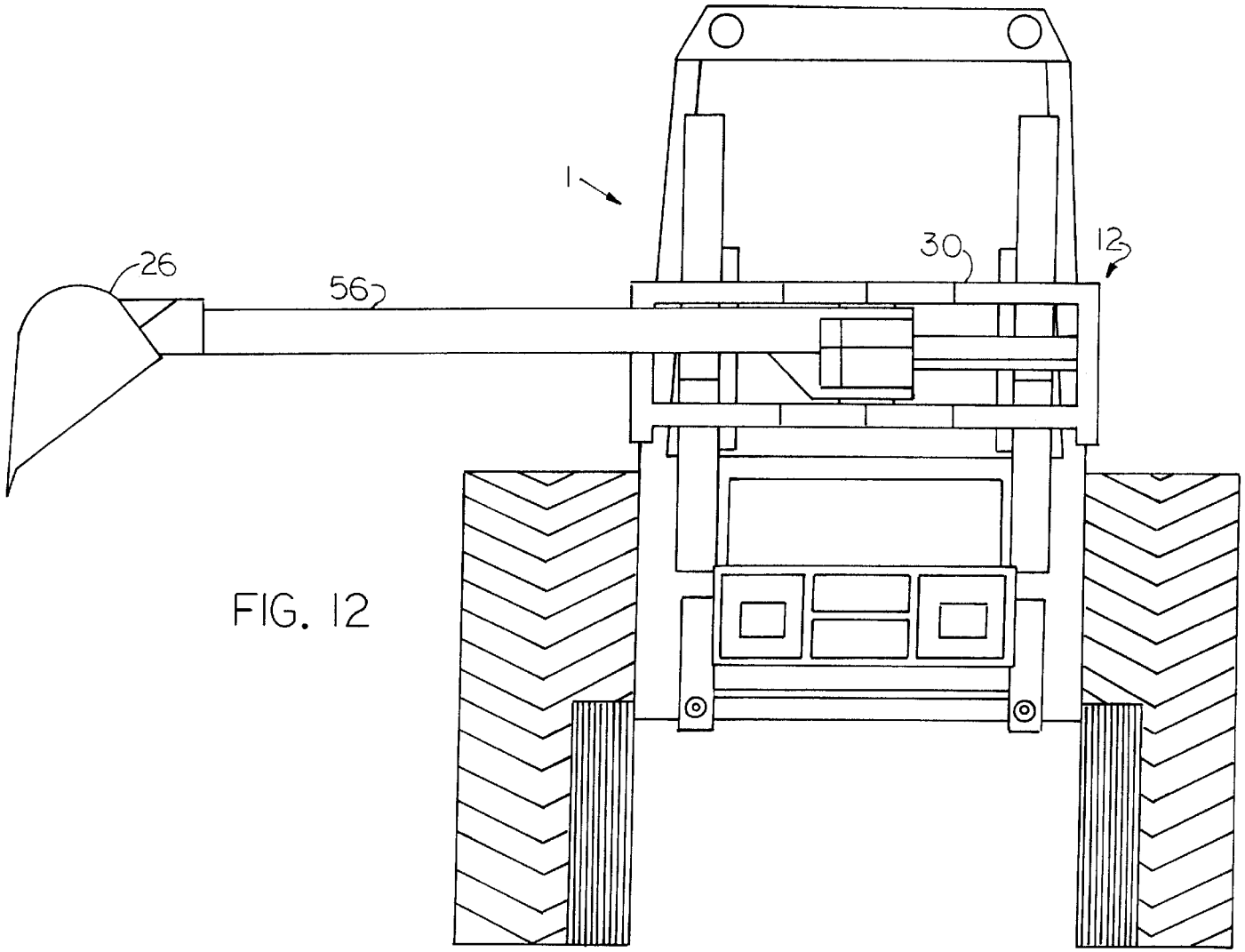
FIGS. 12 and 13 are frontal views of the apparatus.
Figure 13:
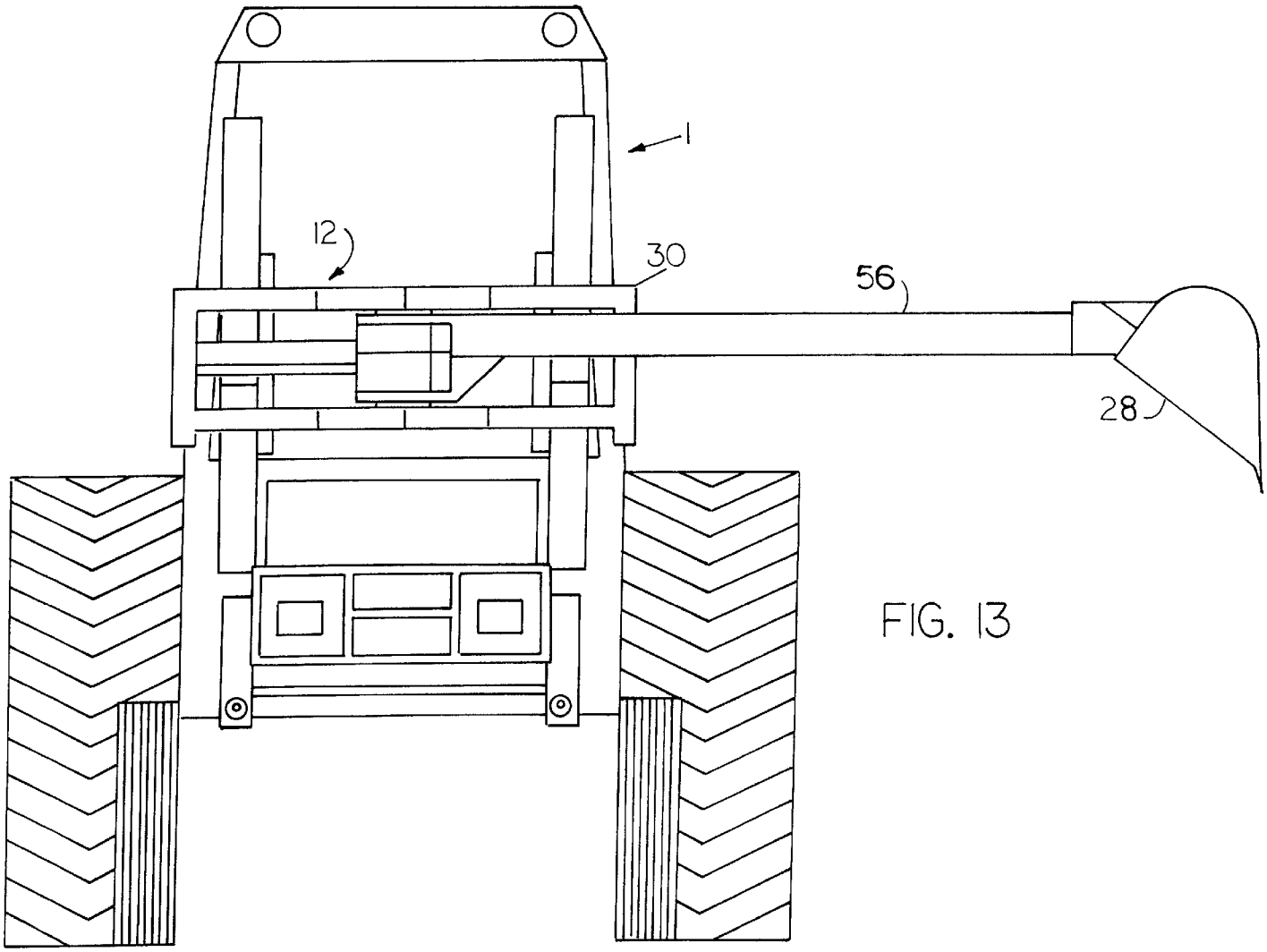

FIGS. 9, 10 and 11 are plan views which provide an illustration of the available movement of the arm 56 and bucket 26 from a central position, FIG. 8, to the right, FIG. 10 and the left FIG. 11. All such movement being effected by the actuator 30. FIGS. 12 and 13 are frontal views of the assembly positions shown in FIGS. 10 and 11 respectively.

Figure 14:
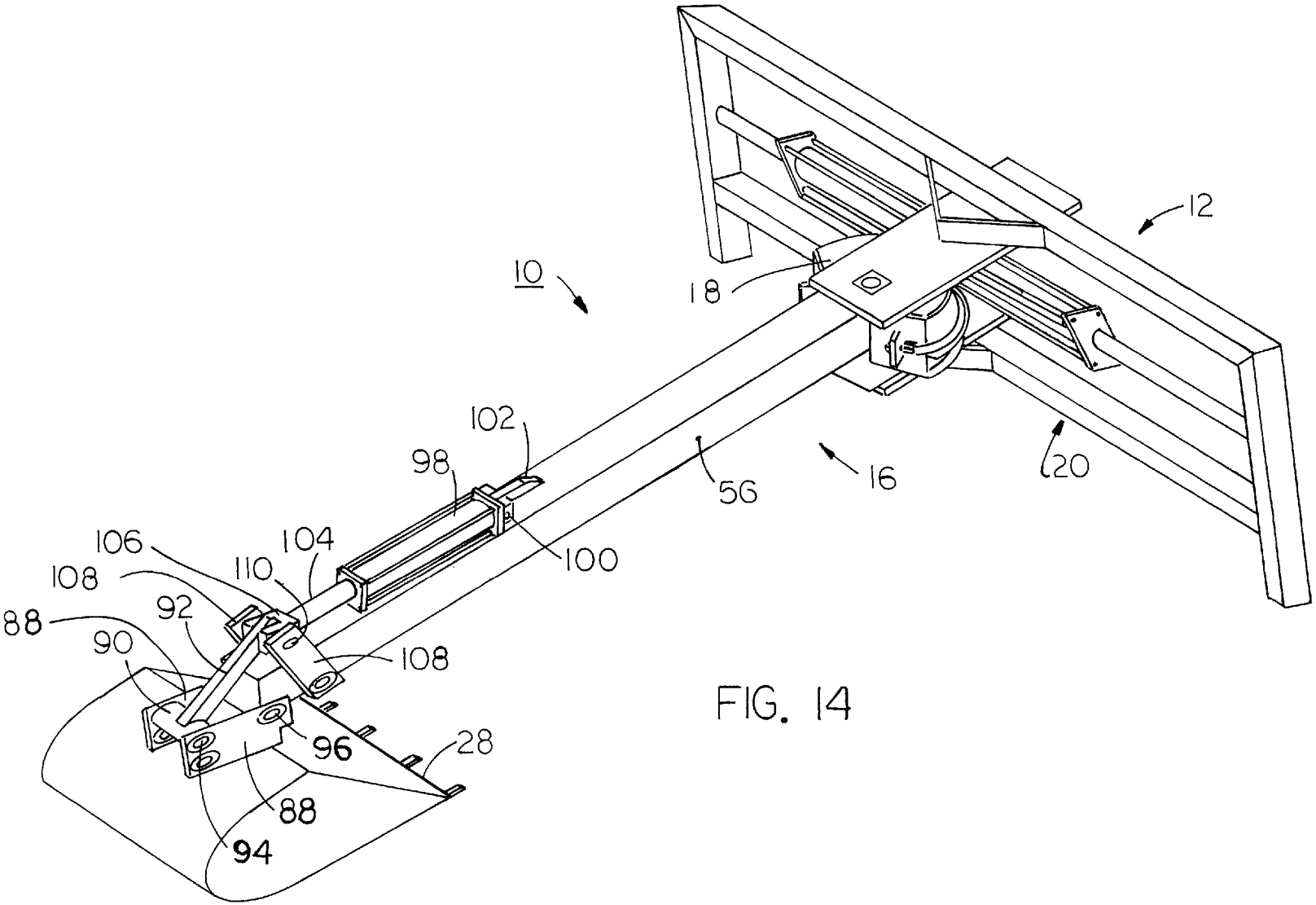
FIGS. 14 and 15 are perspective views of further embodiments of the invention.
Figure 15:
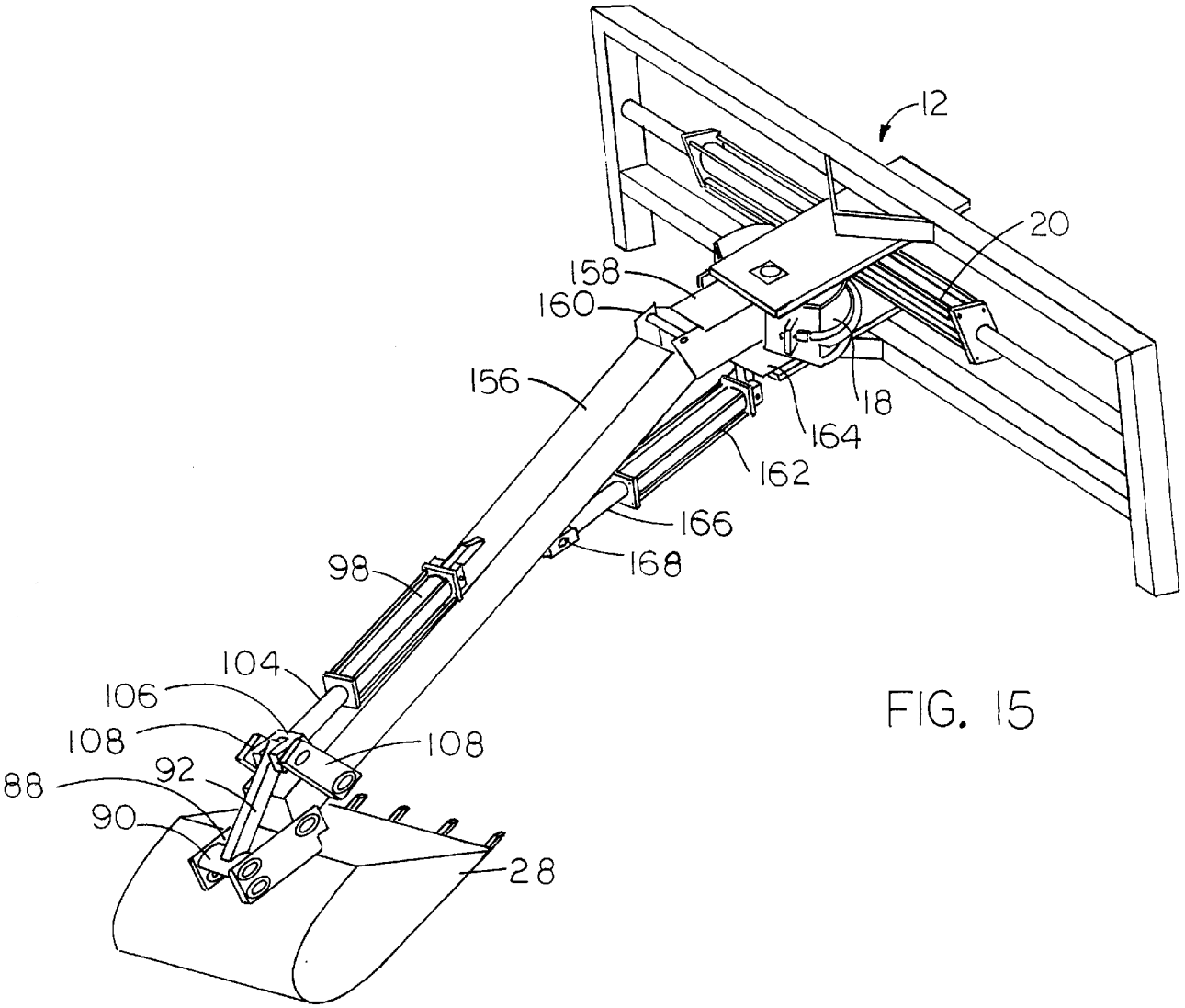

Two modifications of the invention are shown in FIGS. 14 and 15. In FIG. 14 the bucket 28 is pivotally mounted to the outer terminal end of the arm 56 and is hydraulically controlled.

Bucket 28 has a pair of spaced plates 88 secured as by welding to the surface of the bucket, one end of the plates 88 supporting a sleeve 90 and arm 92, the sleeve 90 being located between the plates by means of a pivot pin 94. The other ends of the plates 88 are pivotally mounted at 96 to the opposing side arm of the boom arm 56 adjacent the end thereof.

Hydraulic actuator 98 is pivotally connected at 100 to a plate 102 welded to the upper surface of the arm 56. The outer end of the piston rod 104 of the actuator 98 has a yoke 106 the outside of the arms of which are pivotally secured to a pair of link arms 108 by a pivot pin 110, the other ends of the link arms being pivotally secured to the side surfaces of the boom arm 56. Pivot pin 110 also serves to pivotally secure the free end of arm 92 in and between the arms of the yoke 106.

It will be appreciated that operation of the actuator 98 will serve to rotate the bucket 28 relative to the end of the arm 56 through the interaction of the yoke 106 arms 88, links 108 and sleeve 90 with its arm 92.

A further modification is shown in FIG. 15. As illustrated, the bucket 28 has the rotatable feature of FIG. 14 by means of its linkage to the hydraulic actuator 98. Additionally however, the boom arm is formed into two members, an outer arm 156 which carries the bucket 28 and its associated members and an inner member 158 secured in the drum. The inner end of arm 156 is pivotally connected at 160 to arm 158. This allows the outer arm 156 to arc through a plane normal to the rotation of the drum 18. Movement of the arm 156 is controlled by a ram 162 located underneath the arm, by cylinder end of the ram being connected to a drum support plate 164 (so that the ram body rotates with the drum) and the piston rod 166 of the ram being pivotally connected at 168 to the underside of arm 156.

The modifications particular to FIG. 15 may be utilized with the modifications of FIG. 14 (as is shown in FIG. 15) or such modifications may exclude the FIG. 14 embodiment.

It will be appreciated while the present application has been directed a smaller form of front-end loaders, the invention certainly is applicable to larger front-end loaders as well where a larger frame 12 could be utilized together with either a larger cylinder/drum combination or possibly more than one cylinder in combination with the drum-arm assembly.

Additionally, while the transmission means described herein are flexible chains, strong flexible cables or flexible tooth belts might also be used with satisfactory results.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. An accessory attachment assembly for use on a front-end loader vehicle of the type that includes a pair of actuating arm units for carrying a wide bucket for elevation through a vertical plane and for rotating said wide bucket about a horizontal axis, said attachment assembly comprising:

a) a frame for detachable mounting to said vehicle arm units in place of the wide bucket thereon;

b) a drum pivotally secured to said frame about a vertical axis;

c) a single hydraulic actuator mounted in said frame for reciprocal movement between ends of said actuator, said actuator comprising a cylinder with a coaxial piston shaft therein and having a piston on said shaft and located with said cylinder, the ends of said shaft extending outwardly from both ends of said cylinder and being secured in the ends of said frame;

d) transmission means interconnecting said drum with said actuator whereby movement thereof is said frame effects rotary movement of said drum about its axis of rotation;

e) a boom arm immovably secured at its inner end to said drum and being adapted to carry a ground-engaging tool on its outer, terminal end;

f) said drum comprising a semi-circular cylinder having parallel upper and lower surfaces and mounted for rotation between drum supporting members of said frame; and g) said transmission means comprising a pair of flexible members, each having one of their ends anchored one above the other on opposite side walls of said drum, the other ends of said flexible members being directly connected to opposite ends of said cylinder.

2. An attachment assembly according to claim 1 wherein said frame is of rectangular configuration comprising spaced, parallel upper and lower beams and end members secured thereto, said drum supporting members comprising flat, parallel plate members secured to and extending outwardly from said upper and lower beams in the central region thereof with a pivot pin locating said drum and the inner end of said boom arm between said plates.

3. An attachment assembly according to claim 1 including a collar mounted on each end of said cylinder and means for receiving the end of one of said flexible members secured on said drum.

4. An attachment assembly according to claim 1 wherein said boom arm includes a hydraulic actuator adjacent its outer end and linked to a pivotal connection of said ground-engaging tool for rotating said tool about the outer end of said boom arm.

5. An attachment assembly according to claim 1 wherein said boom arm has an inner section secured in said drum and an outer section pivotally secured to said inner section and hydraulic means interconnecting both sections to affect relative movement therebetween.

* * * * *